United States Patent [19]

Knudsen

[11] 3,941,338

[45] Mar. 2, 1976

[54] DIRECTIONAL WHEEL DETECTOR

[75] Inventor: Will B. Knudsen, Redding Ridge, Conn.

[73] Assignee: Servo Corporation of America, Hicksville, N.Y.

[22] Filed: Sept. 25, 1974

[21] Appl. No.: 509,095

[52] U.S. Cl. ..... 246/77; 246/247

[51] Int. Cl.[2] ..... B61L 13/04

[58] Field of Search ..... 246/34 R, 77, 247, 255

[56] References Cited

UNITED STATES PATENTS 3,359,417 12/1967 Gallagher ..... 246/247

FOREIGN PATENTS OR APPLICATIONS 1,139,873 11/1962 Germany ..... 246/77

*Primary Examiner*—Trygve M. Blix
*Assistant Examiner*—Reinhard J. Eisenzopf
*Attorney, Agent, or Firm*—Kane, Dalsimer, Kane, Sullivan and Kurucz

[57] ABSTRACT

A system is provided for determining the passage of a railroad car wheel along a section of track and the direction of movement of the wheel. The system includes a first wheel sensor mounted adjacent the track and adapted to generate a signal upon the passage of a wheel past the first sensor and while the wheel remains within a length of track associated with the first sensor. The system further includes a second wheel sensor closely spaced along the track from the first sensor and adapted to generate a second signal on the passage of the wheel past the second sensor and while the wheel remains within a length of track associated with the second sensor. The first and second sensors are sufficiently closely spaced to each other so as to provide an overlap between the first and second signals as a wheel passes. Logic means are connected to the outputs of the first and second sensors for determining the direction of travel of the wheel by the sequence of output signals from the sensors.

3 Claims, 4 Drawing Figures

FIG. 1
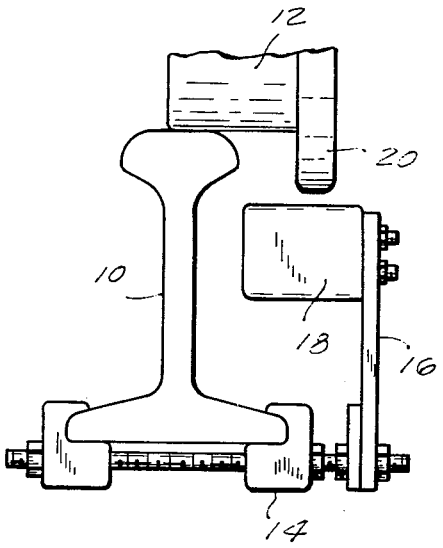
FIG. 2
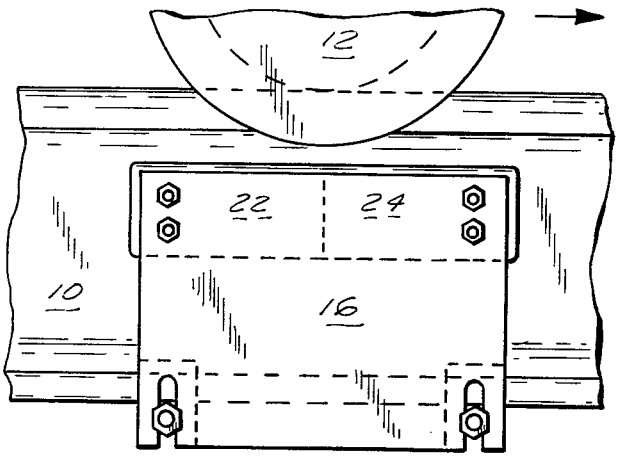
FIG. 3
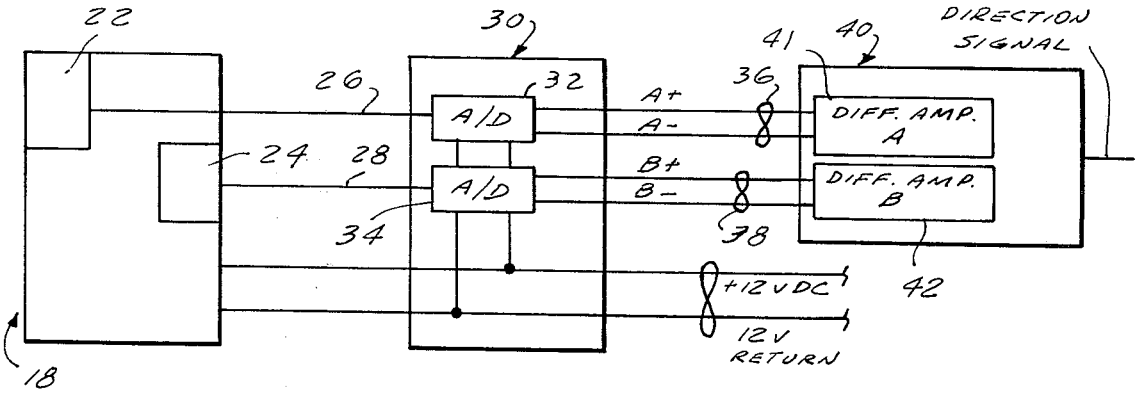
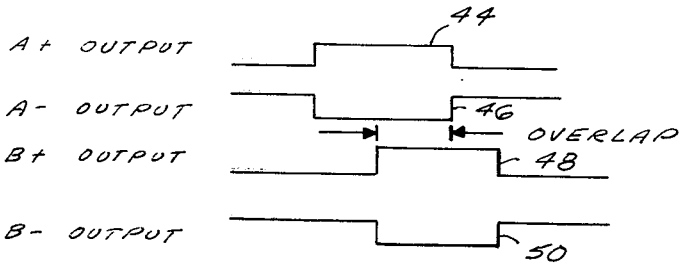
FIG. 4

DIRECTIONAL WHEEL DETECTOR

BACKGROUND OF THE INVENTION

The present invention relates to wheel detectors and more particularly to a detector adapted to determine the presence of a wheel along a section of track as well as the direction of travel of the wheel.

Wheel detectors are used by the railroad industry for a wide variety of applications. They are used to trigger switch signals, automatic car identification equipment, switches, gates and the like. Such detectors utilize sensors, usually track mounted, which may be in the form of metal detectors, treadles, optical devices, etc. which detect the presence of a wheel and generate a signal in response thereto. Heretofore, such wheel detectors have been insensitive to the direction of motion of the passing wheel and the same signal would be generated by a wheel traveling in one direction or an opposite direction.

In view of this, it is the principal object of the present invention to provide a directional wheel detector which will detect railroad car wheels and also indicate their direction.

SUMMARY OF THE INVENTION

The above and other beneficial objects are attained in accordance with the present invention by providing a system for determining the passage of a railroad car wheel along a section of track and the direction of movement of the wheel. The system includes a first wheel sensor mounted adjacent the track and adapted to generate a signal upon the passage of a wheel past the first sensor and while the wheel remains within a length of track associated with the first sensor. The system further includes a second wheel sensor closely spaced along the track on the first sensor and adapted to generate a second signal on the passage of the wheel past the second sensor and while the wheel remains within a length of track associated with the second sensor. The first and second sensors are sufficiently closely spaced to each other so as to provide an overlap between the first and second signals as a wheel passes. Logic means are connected to the outputs of the first and second sensors for determining the direction of travel of the wheel by the sequence of output signals from the sensors.

BRIEF DESCRIPTION OF THE DRAWINGS

In the accompanying drawings:

FIG. 1 is a fragmentary front elevational view, partly in section, of a section of rail, having mounted thereto a directional wheel sensor in accordance with the present invention;

FIG. 2 is a fragmentary side elevational view of FIG. 1;

FIG. 3 is a schematic block diagram of the directional wheel detecting system of the present invention; and, FIG. 4 is a series of graphs depicting, on the same time basis, the voltages developed at the output of the analog to digital converter.

DETAILED DESCRIPTION OF THE PREFERRED EMBODIMENT

Reference is now made to the accompanying drawings wherein similar components bear the same reference numeral throughout the several views. In FIGS. 1 and 2, a section of track rail 10 is depicted carrying a wheel 12 of a passing railroad car. Attached to the rail by clamp 14 and bracket 16 is a housing 18 containing a pair of sensors. In this preferred embodiment, the sensors are of the magnetic type designed to generate a signal in response to the metallic flange 20 of the wheel disturbing the normal magnetic field of the sensors.

As shown in FIG. 2, first and second sensors 22 and 24 are mounted within the housing. The sensors may, for example, be of the type marketed by the SERVO CORPORATION OF AMERICA of Hicksville, N.Y.

In virtually all cases, the diameter of a railroad car wheel in the United States is between 26 and 48 inches. As will be described in more detail forthwith, it is desirable to have the output signals from the sensors 22 and 24 overlap for some period as wheel 12 passes from one sensor to the other. Accordingly, it has been found that in order to obtain this overlap, a minimum distance between the sensors of two inches must be maintained. As the iron of the car wheel approaches and then departs from the magnetic circuits of the sensors 22 and 24 a corresponding signal is generated on lines 26 and 28 which connect the sensors with converters 30 located off the track (for instance, in the bootleg). The converters comprise a pair of analog/digital circuits 32 and 34 associated respectively with sensors 22 and 24. The converters 32 and 34 convert the sensor signals to buffered digital, differential signals which can be transmitted in twisted, shielded pairs 36 and 38 a considerable distance to logic circuits 40. The converters and sensors are powered as shown.

The logic circuit 40 comprises, for example, a pair of differential amplifiers 41 and 42. The input to differential amplifier 40 as wheel 12 moves in the direction indicated by the arrow in FIG. 2 is shown by curves 44 and 46 of FIG. 4. The input to differential amplifier 42 is shown in curves 48 and 50 of FIG. 4. The logic circuit 40 also includes means for detecting the sequence of outputs from the differential amplifiers.

Considering the output of differential amplifier 41 as A and the output of differential amplifier 42 as B, if the following sequence of outputs from the differential amplifiers 41 and 42 is detected, the train is traveling in the direction indicated in FIG. 2:

$A = 0, B = 0$ $A = 1, B = 0$ $A = 1, B = 1$ $A = 0, B = 1$ $A = 0, B = 0$

If the train wheel is traveling in the opposite direction, the following sequence will be detected:

$B = 0, A = 0$ $B = 1, A = 0$ $B = 1, A = 1$ $B = 0, A = 1$ $B = 0, A = 0$

The sequence of signals thus provides indication of the direction of movement of the wheel.

Thus, in accordance with the above, the aforementioned objectives are attained.

Having thus described the invention, what is claimed is:

1. A detecting system for determining the passage of a railroad car wheel along a section of track and the direction of movement of said wheel, said system comprising: a first wheel sensor mounted adjacent said track to generate a first signal upon the passage of a wheel past said first sensor and while said wheel remains within a length of track associated with said first sensor; a second wheel sensor closely spaced along said track from said first sensor to generate a second signal upon the passage of said wheel past said second sensor and while said wheel remains within a length of track associated with said second sensor; said first and second sensors being sufficiently closely spaced to each other so as to provide an overlap between said first and second signals as a wheel passes said first sensor toward said second sensor; logic circuit means connected to the outputs of said first and second sensors for determining the direction of travel of the wheel by sequence of outputs from said sensors, and first analog to digital converter means interposed between said first sensor and said logic means and a second analog to digital converter means interposed between said second sensor and said logic means.

2. The detecting system in accordance with claim 1 wherein said first and second sensors are spaced along the track so that said overlap will occur when a wheel travels a minimum distance of 2 inches.

3. The detecting system in accordance with claim 1 wherein said logic circuit means comprises a first differential amplifier connected to the output of said first analog to digital converter and a second differential amplifier connected to the output of said second analog to digital converter.

* * * * *